United States Patent [19]

Kalka et al.

[11] Patent Number: 4,470,655

[45] Date of Patent: Sep. 11, 1984

[54] TRANSITION CONNECTOR

[75] Inventors: James C. Kalka, St. Paul; Jerry A. Walter, Ogema, both of Minn.

[73] Assignee: Minnesota Mining and Manufacturing Company, St. Paul, Minn.

[21] Appl. No.: 90,149

[22] Filed: Nov. 1, 1979

[51] Int. Cl.[3] ..... H01R 13/38

[52] U.S. Cl. ..... 339/99 R

[58] Field of Search ..... 339/97 R, 97 P, 98, 339/99 R, 176 MF

[56] References Cited

U.S. PATENT DOCUMENTS

| | | | |
|---|---|---|---|
| 2,965,870 | 12/1960 | Kuehn | 339/221 R |
| 3,434,093 | 3/1969 | Wedekind | 339/99 R |
| 3,990,767 | 11/1976 | Narozny | 339/97 P |
| 4,190,952 | 3/1980 | Thomas et al. | 339/99 R |
| 4,418,977 | 12/1983 | O'Shea | 339/99 R |

FOREIGN PATENT DOCUMENTS

| | | | |
|---|---|---|---|
| 2738869 | 3/1979 | Fed. Rep. of Germany | 339/99 R |
| 2033676 | 5/1980 | United Kingdom . | |

*Primary Examiner*—Neil Abrams

*Attorney, Agent, or Firm*—Donald M. Sell; James A. Smith; Terryl K. Qualey

[57] ABSTRACT

A transition connector in which all contact elements are identical has opposing teminals connected by a foldable strap to permit keeping all the terminals of each set at the same extended length. The contact elements are anchored to the insulative carrier for security during assembly.

8 Claims, 8 Drawing Figures

TRANSITION CONNECTOR

This invention relates to electrical connectors, and more particularly to connectors for use with multiple conductive elements having different pitch or spacing.

Flat cable is available in various pitches, and various means for interconnecting the conductors of such cables, or of a cable with a connector of a different pitch, have been described. Where the pitch of one cable is one-half that of the other, the adapter of U.S. Pat. No. 3,777,299 is useful. In the more usual case wherein the pitch of one cable is not a multiple of that of the other, connectors as described in U.S. Pat. Nos. 3,990,767 and 4,147,399 have been suggested. The former employs a series of identical double-ended contact elements, the two ends being connected by hinged rigid parallel plates, one set of ends progressively diverging from axial alignment with the other set of ends and thus terminating along an arcuate path. In the structure of U.S. Pat. No. 4,147,399, both sets of ends terminate along a flat path but the contact elements are not identical.

The present invention makes possible the use of identical contact elements which can therefore be produced in quantity with maximum efficiency and economy and which reduce the possibility of error in the assembly of the connectors. Both sets of contact element ends terminate along a flat path thereby insuring full electrical contact at each contact element without requiring an unduly long terminal.

These and other advantages are attained by means of a contact element having a deformable flat strap connector between the two terminals, together with an insulative support means which supports the element and the two terminals while permitting deformation of the connector strap to the extent required by the necessary offsetting of ends, all as will be further described in conjunction with the accompanying drawing, in which.

Figure 1:
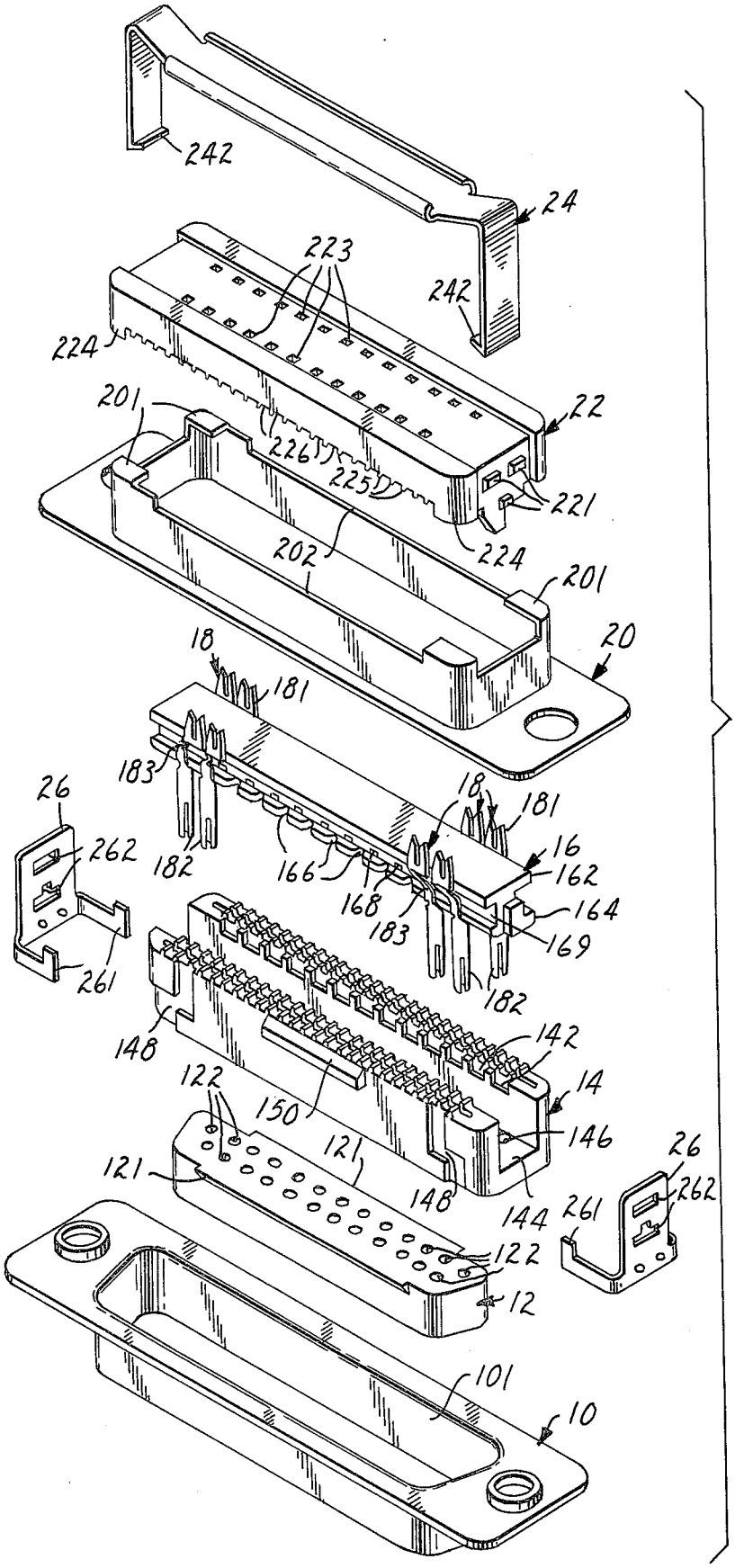
FIG. 1 is an exploded view in perspective indicating the components and arrangement of one form of connector, and, on an enlarged scale.
Figure 3:
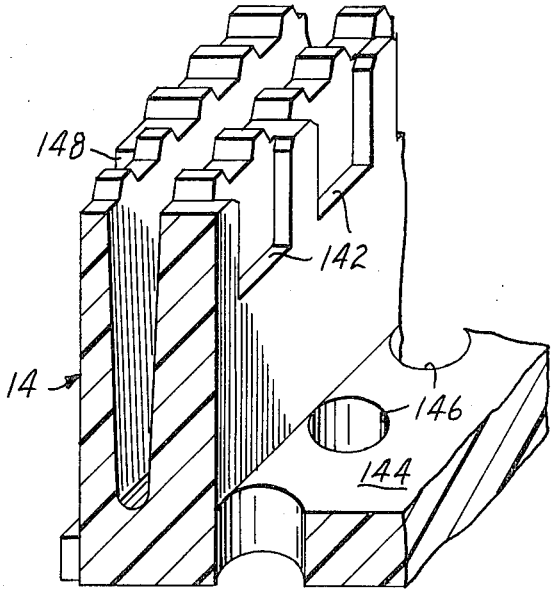
Figure 4:
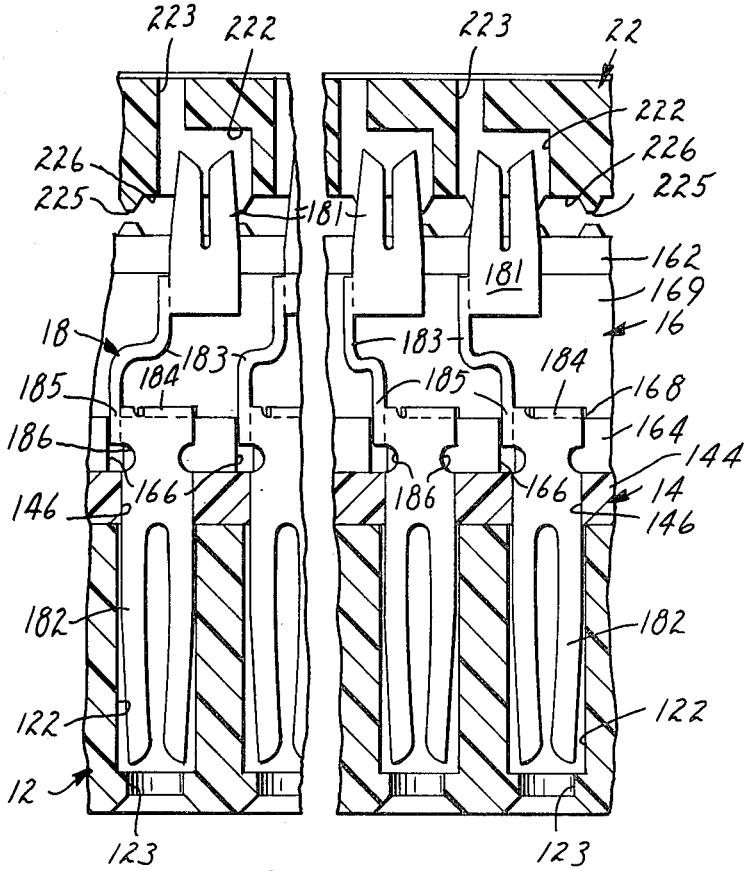
Figure 5:
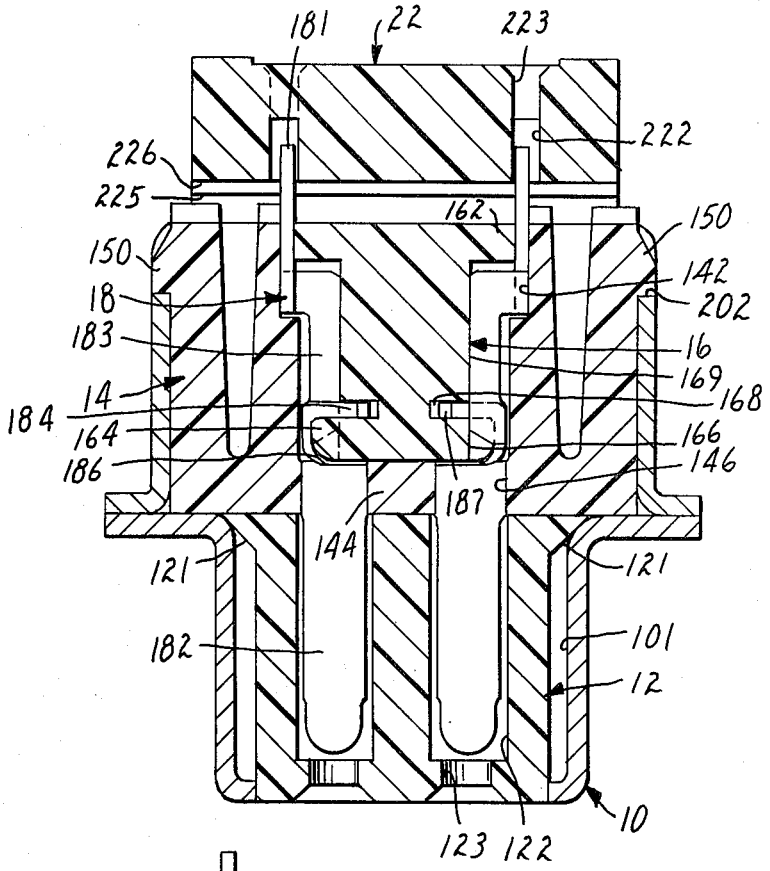
Figure 6:
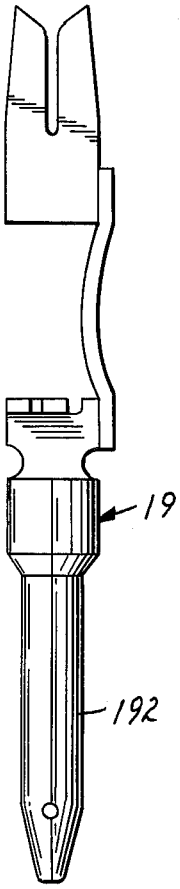
Figure 7:
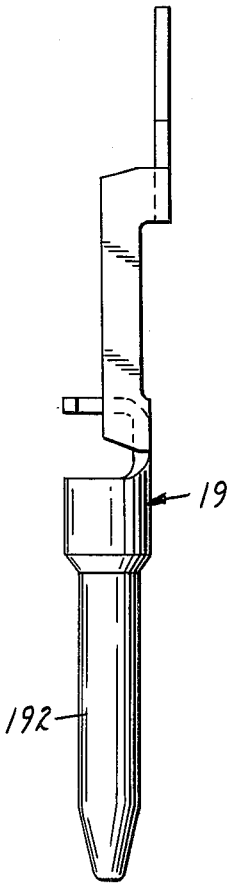
Figure 8:
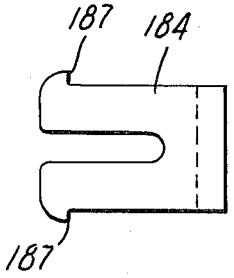

FIG. 3 is a partial view in perspective of the insulating container component, FIG. 4 is a partial longitudinal sectional elevation of the assembled connector of FIG. 1, FIG. 5 is a partial transverse sectional elevation of the assembled connector of FIG. 1, FIG. 6 is a front elevation, and FIG. 7 a side elevation, of another form of contact element, and FIG. 8 is a plan view of anchoring means as carried by the contact elements of FIGS. 4–7.

The connector illustrated in FIG. 1 will be seen to consist of a lower shell 10, a lower insulator 12, a trough-like insulating container 14, an insulating contact element carrier 16, a multiplicity of contact elements 18, an upper shell 20, an insulating cover 22, a strain relief spring clamp 24 (optional), and retaining clips 26. Certain of these components are illustrated and described in greater detail in connection with the other figures. Designations such as "upper" and "lower" are supplied for convenience and will be understood to refer only to the positions shown in the drawings.

In assembling the connector of FIG. 1, contact elements 18 are first applied and anchored to insulating carrier 16 which is then inserted within trough-like container 14. Clips 26 are applied to the ends of the composite and the whole is inserted into upper shell 20. Lower insulator 12 is inserted in lower shell 10, with edge ridges 121 pressing against the inner edges 101 of the shell and with the top of the insulator fitted against the bottom of the upper assembly; and the two shells are fastened together. Attachment to an appropriate flat cable is accomplished by compressing the cable between the upper surface of the connector and the lower surface of the cover 22. For some installations the cable is folded back over the top of the cover, and a spring clamp 24 is then applied to hold the cable securely in place.

Figure 2:
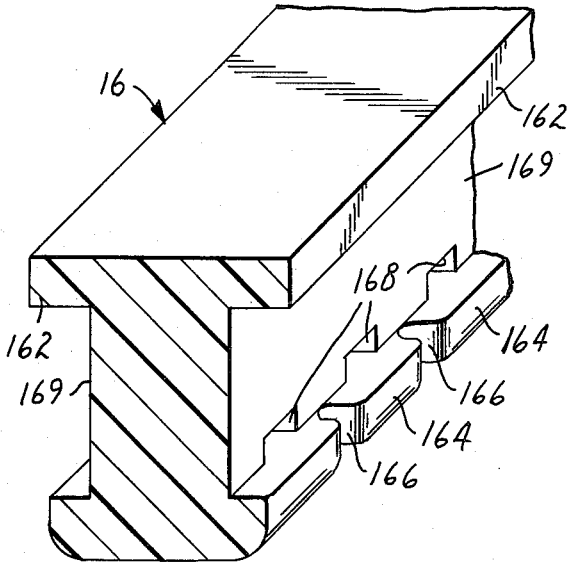
FIG. 2 is a partial view in perspective of the contact carrier component.

Carrier 16 is more clearly shown in FIG. 2 to have the general shape of an I-beam, having along both longitudinal edges continuous upper overhangs 162 and interrupted or crenelate lower overhangs 164 defining a central channel 169. Above each crenel or notch 166 in the lower overhang there is provided a perforation 168 in the central beam, for a purpose which will be made apparent.

The trough-like container 14 is notched along both upper inner edges at notches 142 and the bottom 144 is correspondingly perforate at perforations 146 (see FIG. 3). The side walls are grooved near their ends at grooves 148 (FIG. 1) to receive arms 261 of clips 26 which fit against the appropriately shaped ends of carrier 16 and cover 22, the bosses 221 of the latter fitting within slots 262 of the clips. The lower of slots 262 also receives the turned edges 242 of the clamp 24 when used. Elongate bosses 150 along the upper outer wall edges of container 14 rest against the depressed side walls 202 of the upper shell 20, and corner braces 201 of the shell press against the upper corners of container 14 and carrier 16, holding the insulative components firmly together and within the shell.

The form of contact element 18 shown in detail in FIGS. 4 and 5 is designed to make connection between a wire conductor and a pin or male contact member. For such purpose the element includes an upper bifurcate plate or U-contact terminal 181, for example as described in U.S. Pat. Nos. 3,189,863 or 3,444,506, and a lower split tubular socket or female terminal 182. The two are connected together by an intervening flat deformable strap 183. A barbed bifurcate plate 184 extends from near the juncture of the strap and one of the terminals and across and beyond the width of the strap.

The tubular terminal 182 joins the strap 183 through a connecting strip 185 from the upper edge of which the plate 184 extends. Strip 185 is centrally narrowed at arcuate indentations 186 to facilitate conversion from the arcuate shape at the top of the tubular terminal to the flat shape at the juncture with the anchor plate 184. The lower end of the strap 183 fits snugly within the slot 166. The terminal is firmly held against axial movement by contact of the top of the tubular terminal 182 with the bottoms of the crenels 164 and by the anchoring effect of the plate 184 and strip 185. An important feature of these contact elements is that they are formable from a single flat plate of metal.

As shown more particularly in FIG. 5, the anchor plate 184 is inserted in the aperture 168. The bifurcate structure permits the plate to compress slightly during insertion, and the barbs 187 then securely retain the plate within the aperture. By this means the several contact elements are held in place against the carrier 16 during further manipulation.

The tubular terminals 182 are inserted through the apertures 146 in the base 144 of the container 14 and lie within corresponding holes 122 in the lower insulator 12, being accessible through the slightly constricted openings 123.

The U-contacts 181 fit into the notches 142 in the notches 142 in the inner walls of the container 14 and against the outer face of the upper overhang 162. The lower edge of the U-contact rests against the lower surface of the notched area, and the upper extension of the strap 183 to which the U-contact is attached rests against the lower face of the overhang, thereby confining the U-contact against axial movement.

The deformable or foldable strap 183 connecting terminals 181 and 182 lies within the channel 169, with sufficient space to ensure freedom to fold without contacting any adjacent contact element.

The cover 22 contains slot-like perforations 222 open at the surface adjacent the carrier 16 and at locations corresponding to the position of the notches 142, and into which the U-contacts 181 extend. The perforations are dimensioned to provide a close fit against the flat sides of the contacts but to permit the required degree of edgewise expansion of the contacts when the latter are forced over the wires of a cable. Test openings 223 permitting the introduction of a test probe to the contact area may be incorporated if desired.

The lower surface of the cover 22 may also be formed with transverse alternate ridges 225 and grooves 226 corresponding to the longitudinal ridges and grooves of a multi-conductor flat cable. As here illustrated, the cover is further provided with stepped ends 224 corresponding with the positions of the corner braces 201, the intervening longitudinal distance being equal to the width of the flat cable to which connection is desired. It is sometimes helpful to add a thin layer of pressure-sensitive adhesive over the cable-contacting surface of the cover, to impart further holding properties useful particularly during application of the connector to a cable.

For a transition connector it is to be understood that the pitch or spacing of the upper terminals will differ from that of the lower. Thus the U-contacts of the connector as just described may be either closer together or farther apart than are the tubular contacts. For purposes of making effective contact both with a cable and with another pin or tube connector, the terminals must be perpendicular to parallel planes, i.e. to the parallel upper and lower faces of the carrier 16. The tips of the upper terminals should lie in a flat plane to assure proper contact with the flat cable. The tips of tubular or pin type terminals should also lie in a flat plane to assure proper contact and closure with a complementary pin or tube connector and without requiring tubes or pins of undue length. These several requirements are met in the devices of the present invention.

It is usually most convenient to arrange a central contact element with its two terminals on the same axis. Assuming the pitch of the lower terminals to be greater than those of the upper terminals, it will be apparent that planar positioning of the terminal tips will require that maximum folding or deformation of the connecting straps must occur at said central contact element, and minimum folding at elements farthest removed therefrom. An intermediate degree of relative displacement of terminals and folding of straps 183 is illustrated in FIG. 4.

In the contact element 19 of FIGS. 6 and 7 a pin or male terminal 192 replaces the split tubular terminal 182 of element 18, the remaining components being identical. Where the pin type terminal is used, the lower insulator is eliminated, and the lower shell 10 is replaced by an otherwise similar shell, not shown, having a larger opening and capable of fitting closely about the dependent portion of a lower shell 10 or that of another similarly dimensioned connector having female or tube type terminals.

In a specific illustrative example, a connector as hereinabove described contains a total of 25 contact elements having U-contact upper and female tubular lower terminals, located in two parallel rows of 12 and 13 elements respectively. The upper rows are spaced apart 4.9 mm. and the terminals are spaced apart 2.5 mm. in each row, center to center. The lower rows are spaced 2.85 mm. apart and the terminals 2.8 mm. in each row, center to center. The assembly is used for transition between the wires of a flat cable 31.75 mm. in width and typically containing 25 No. 28 B & S gage wires at a pitch (center to center spacing) of 1.27 mm., and a standard pin type connector having a pitch of 1.37 mm.

In the light of the foregoing detailed description it will be apparent that transition connectors embodying the same principles may be constructed for interconnecting directly between two cables as well as for interconnecting between standard pin or tube type connectors of different pitch. In all such modifications, change in pitch is accomplished with a group of identical contact elements and in a structure wherein the extended length of all terminals of each form is identical.

What is claimed is as follows:

1. A transition connector comprising insulative support means including parallel upper and lower plane surfaces and supporting a multiplicity of identical contact elements each having a bifurcate plate U-contact upper terminal extending perpendicularly and to a common distance from said upper surface and a lower terminal extending perpendicularly and to a common distance from said lower surface, said upper terminals being uniformly spaced apart by a first distance, said lower terminals being uniformly spaced apart by a second distance different from said first distance, the upper and lower terminals of each said contact element being connected by a single deformable flat strap having its major faces in planes perpendicular to the major faces of the bifurcate plate contact of the contact element, the straps of the contact elements central of said connector being more severely deformed than those at the ends of said connector, said support means including an inner carrier body having a crenelated lower edge and fitting within an outer trough-like container having a perforate base and a multi-notched upper inner edge, the crenels of said lower edge being spaced apart by said second distance to receive said lower terminals, the notches of said upper edge being spaced apart by said first distance to receive said upper terminals, the base of said container being perforate to receive said lower terminals, said carrier body being channeled along its edge to provide free space for the said deformable straps of said contact elements, and each said contact element including anchor means for anchoring said contact element to said carrier body.

2. The transition connector of claim 1 wherein said carrier body is provided with an edge perforation adjacent each said crenel and each said anchor means is retained within a said perforation.

3. The transition connector of claim 1 wherein said U-contacts are contained within the notches in said container and said lower terminals extend through the perforations in said base.

4. The transition connector of claim 3 wherein said lower terminals are male terminals.

5. The transition connector of claim 3 wherein said lower terminals are female terminals and including a perforate insulator surrounding said terminals.

6. The transition connector of claim 1 including a cover member fitting against said upper plane surface and slotted to receive said U-contacts.

7. The transition connector of claim 1 wherein said contact element anchor means comprises a flat plate adjacent said flat strap with its major faces in planes perpendicular to the major faces of said flat strap and said bifurcate plate U-contact.

8. The transition connector of claim 17 wherein said contact element anchor means terminates in opposing outwardly barbed arms.

* * * * *